US006082388A

United States Patent [19]

Turrin et al.

[11] Patent Number: 6,082,388

[45] Date of Patent: Jul. 4, 2000

[54] CONTROL DEVICE FOR GAS BURNERS

[75] Inventors: Gianpiero Turrin; Pierluigi De' Stefani, both of Padua; Vanni Gallocchio, Abano Terme, all of Italy

[73] Assignee: Sit La Precisa S.r.l., Padua, Italy

[21] Appl. No.: 09/042,647

[22] Filed: Mar. 17, 1998

[30] Foreign Application Priority Data

Mar. 19, 1997 [IT] Italy ..... PD97A000055

[51] Int. Cl.[7] ..... F23D 14/72; F23N 5/10; F23Q 9/10; F23Q 9/12; F16K 31/02

[52] U.S. Cl. ..... 137/66; 126/503; 431/54; 431/60; 431/281

[58] Field of Search ..... 137/65, 66; 431/48, 431/51, 52, 53, 54, 60, 280, 281; 126/503, 512

[56] References Cited

U.S. PATENT DOCUMENTS

| | | | |
|---|---|---|---|
| 2,409,947 | 10/1946 | Mantz | 137/66 |
| 2,588,179 | 3/1952 | Thornberry | 137/66 |
| 2,791,212 | 5/1957 | Hollman et al. | 431/280 |
| 2,799,454 | 7/1957 | Rouse | 137/66 |
| 2,945,369 | 7/1960 | Seegert | 137/66 |
| 2,946,376 | 7/1960 | Thornberry et al. | 431/54 |
| 3,129,884 | 4/1964 | Baatrup | 431/280 |
| 3,550,603 | 12/1970 | Schueler | 137/66 |
| 3,561,896 | 2/1971 | Riehl | 431/281 |
| 3,597,138 | 8/1971 | Ray | 137/66 |
| 3,685,730 | 8/1972 | Katchka | 137/66 |
| 3,763,875 | 10/1973 | Mobus et al. | 137/66 |
| 3,841,552 | 10/1974 | Kinsella et al. | 431/54 |
| 3,875,956 | 4/1975 | Katchka | 137/65 |
| 3,884,413 | 5/1975 | Berquist | 431/280 |
| 4,081,235 | 3/1978 | Van Der Veer | 137/66 |
| 4,242,080 | 12/1980 | Tabei | 137/66 |
| 4,543,974 | 10/1985 | Dietiker et al. | 137/66 |
| 5,575,274 | 11/1996 | DePalma | 126/503 |
| 5,718,256 | 2/1998 | Buezis et al. | 137/66 |
| 5,890,485 | 4/1999 | Shimek et al. | 126/503 |

FOREIGN PATENT DOCUMENTS

| | | | |
|---|---|---|---|
| 1204528 | 9/1970 | United Kingdom | 431/60 |

*Primary Examiner*—George L. Walton
*Attorney, Agent, or Firm*—Sughrue, Mion, Zinn, Macpeak & Seas, PLLC

[57] ABSTRACT

The device comprises a safety valve with an actuator which can be armed manually, a regulation valve disposed in a duct downstream of the safety valve for supplying a main burner, a tapping duct for supplying a pilot burner, and a flame detector for the pilot burner for supplying the actuator of the safety valve with sufficient energy to hold the safety valve open after manual arming has taken place and the pilot light has been lit. In order also to supply another burner without compromising the safety of the device, an on/off valve provided in a duct branching off the main duct between the safety valve and the regulation valve has an operating member coupled to the manual arming member of the actuator of the safety valve for keeping the on/off valve in a condition in which it shuts off the branch duct during the manual arming of the safety-valve actuator.

14 Claims, 5 Drawing Sheets

CONTROL DEVICE FOR GAS BURNERS

BACKGROUND OF THE INVENTION

The present invention relates to a device for controlling the supply for gas burners.

A known device for controlling the supply for gas burners used, for example, in heating apparatus, comprises two closure valves arranged in series in the supply pipe of a main burner. The first is a safety valve operated, for example, by an electromagnetic unit supplied by a thermocouple heated by the flame of a pilot burner, and the second is a thermostatic regulation valve.

The electromagnetic unit is armed manually so as to open the safety valve and to allow the gas to flow towards the pilot burner.

Devices for controlling gas supply of the type described above are suitable for supplying a single burner, naturally in addition to the pilot burner. In fact, if a secondary burner were to be supplied independently of the main burner, it would be necessary to provide a duct branching off the main duct between the safety valve and the regulation valve. In this case, however, at the lighting stage, that is, when the safety valve is opened manually in order to supply the pilot burner, the secondary burner would also be supplied which, for safety reasons, is not allowed.

SUMMARY OF THE INVENTION

The main object of the present invention is to propose a device for controlling gas supply of the type described above which also enables a secondary burner to be supplied whilst preventing the safety problem mentioned in a simple manner.

This object is achieved, according to the invention, by the provision, in the device, of an on/off valve disposed in a duct branching off the main duct between the safety valve and the regulation valve, with operating means associated with the manual operating member of the actuator of the safety valve so as to keep the on/off valve in a condition in which it shuts off the branch duct during the manual arming of the safety-valve actuator.

BRIEF DESCRIPTION OF THE DRAWINGS

The invention will be understood better from the following detailed description of a preferred embodiment thereof given with reference to the appended drawings, in which.

DETAILED DESCRIPTION OF THE INVENTION

Figure 1:
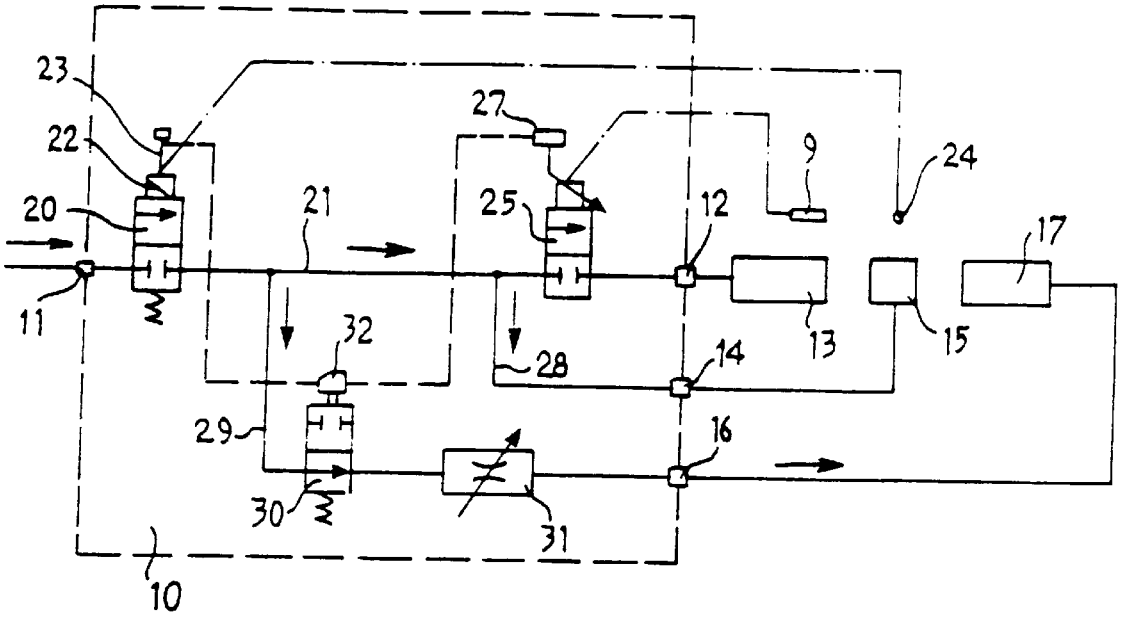
FIG. 1 is a diagram showing the operation of the device according to the invention.

With reference to FIG. 1, the device for controlling gas supply, shown enclosed in a rectangle 10, receives fuel gas through an inlet opening 11 and supplies it to a main burner 13 through a first outlet opening 12, to a pilot burner 15 through a second outlet opening 14, and to a secondary burner 17 through a third outlet opening 16. By way of example, the main burner 13 could be associated with room-heating apparatus disposed in a fireplace, the secondary burner 17 could be arranged in the fireplace in order to create an essentially decorative flame simulating flames from burning wood or coal disposed in the fireplace and the pilot burner 15 could be associated with the main burner and with the secondary burner in order to provide a pilot light for igniting the flames of the associated burners.

A safety valve 20, for example, an electromagnetic valve, receives the gas from the opening 11 at its inlet and, when open, supplies the gas from its outlet to a main gas duct 21. The safety valve 20 has an actuator 22 with a manual arming member, indicated 23. A flame detector 24 disposed in the vicinity of the pilot burner 15 supplies the actuator 22 with an indication of the presence of a pilot light. Preferably, the actuator 22 is an electromagnet and the detector 24 is a thermocouple which can supply the electromagnet with sufficient current to keep the safety valve 20 open after it has been armed by means of the manual arming member 23 and the pilot light has been lit.

A regulation valve 25 is connected between the main duct 21 and the first outlet opening 12. It is preferably a thermostatic valve regulated by a temperature signal from a temperature sensor 9 and adjusted manually by means of a knob 27.

Branching off the main duct 21 are a tapping duct 28 in communication with the second outlet opening 14 in order to supply gas to the pilot burner 15, and a secondary or branch duct 29 in communication with the third outlet opening 16 in order to supply gas to the secondary burner 17. An on/off valve 30 and a manual flow-adjustment valve 31 are arranged in series in the secondary duct 29. The on/off valve 30 has operating means 32 coupled mechanically to the manual arming member 23 of the safety valve 20 and, in this embodiment, also to the knob 27 of the regulation valve 25.

As in the known device described at the beginning, the electromagnet 22 is armed manually by means of the arming member 23 in order to open the safety valve 20, allowing gas to flow towards the pilot burner 15. The mechanical coupling between the arming member 23 and the operating means 32 of the on/off valve 30 is such that the on/off valve is kept closed during arming. This prevents any gas from passing from the main duct 21 to the secondary burner 17. In these conditions, it is also impossible for gas to reach the main burner 13 because the regulation valve 25 is closed. In fact, this valve may be formed in a manner such that the knob 27 is locked in a closure position during the lighting stage.

Upon release of the arming member 23 after the pilot light has been lit, the operating means 32 of the on/off valve remain in the closure position owing to the mechanical coupling with the manual arming member 23 so that the valve remains closed, preventing gas from flowing towards the secondary burner 17. Mechanical disconnection of the operating means 32 and the arming member 23, brought about by the rotation of the knob 27 as will be explained in detail in the following description, opens the on/off valve, allowing the gas to flow towards the secondary burner 17 where a flame or a bed of flames is lit by the pilot light of the burner 15. The gas given out from the main burner 13 can now be lit by the same pilot light.

The flow-adjustment valve 31 enables the flame of the secondary burner 17 to be modulated at will.

Figure 2:
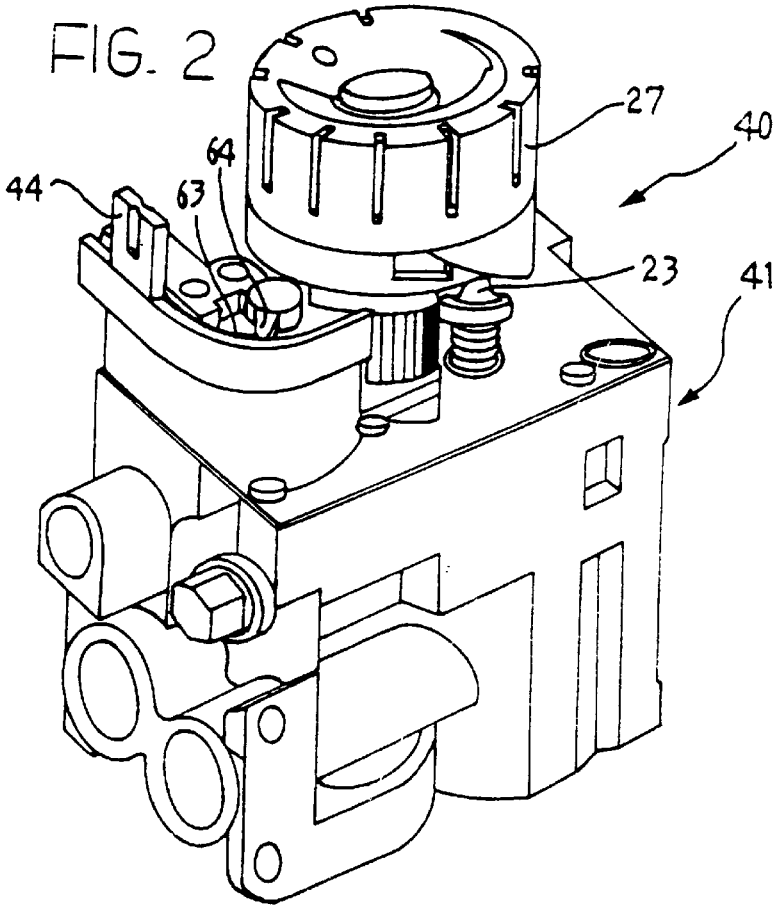
FIG. 2 is a partial perspective view of a device according to the invention.
Figure 3:
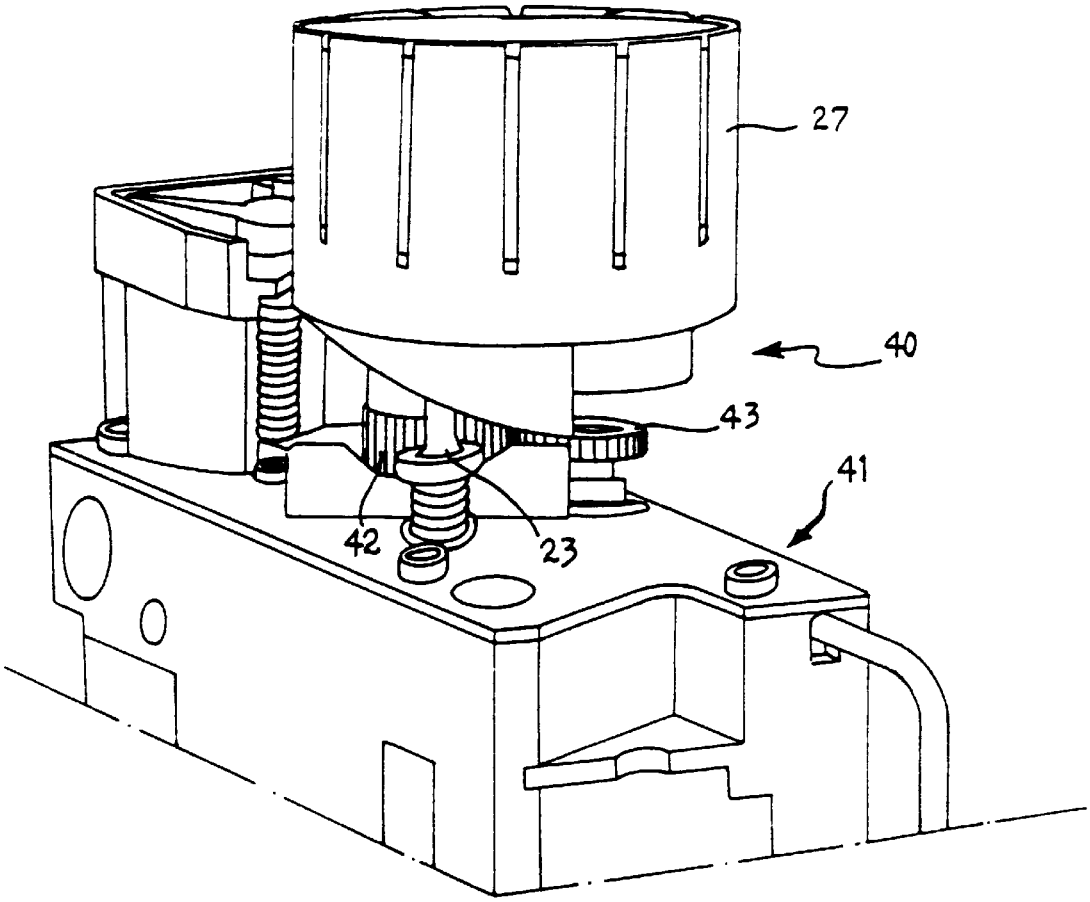
FIG. 3 is a perspective view of a portion of the device according to the invention from a different view point.

As shown in FIGS. 2 and 3, the device 10 has a control unit 40 and a valve body 41. The latter contains the safety valve 20, the manual arming member 23, the regulation valve 25, the on/off valve 30 and its operating means 32, as well as the flow-adjustment valve 31. Only some of the parts contained in the valve body are shown and described, that is, only those which relate to the most characteristic aspects of the invention. The others are of known type and do not therefore require detailed description since they can be implemented by an expert in the art.

The manual operating members of the control unit 40 are the knob 27 which acts, by means of a pair of gears 42 and 43, on the regulation valve 25 (FIG. 1) in order to modify its intervention threshold manually, and a slide 44 which controls the flow-adjustment valve 31 (FIG. 1).

The on/off valve 30 has a rod 45 slidable inside the valve body 41 and an operating element 49 which interferes with a cam-like projection 46 of the knob 27. As can be seen in FIGS. 4 to 7, the rod 45 carries a first annular closure plate 47 which can close a first seat 50 which puts a duct 51 formed in the valve body into communication with a duct 52 which opens into the secondary outlet opening 16.

The duct 51 in turn is always in communication with the secondary duct 29 through a hole 53 calibrated by a screw 54 for adjusting the minimum gas-flow. The duct 51 is also in communication with the secondary duct 29 by means of a second seat 55 which can be closed by a respective second closure element 56.

Figure 4:
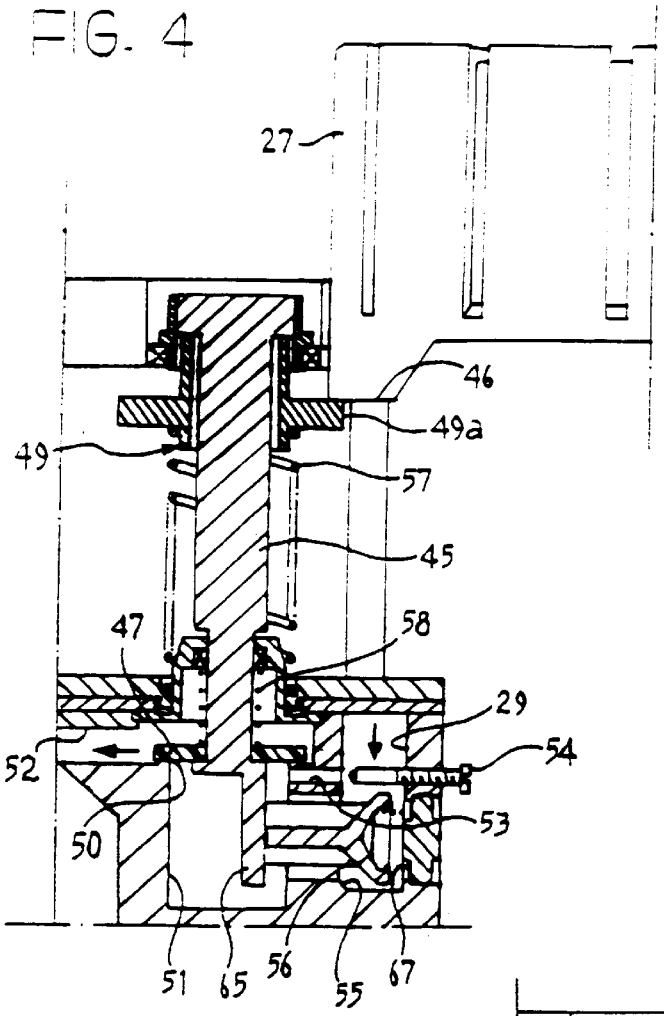
FIGS. 4 to 7 are partially-sectioned views of a valve of the device according to the invention in corresponding different operating conditions.
Figure 5:
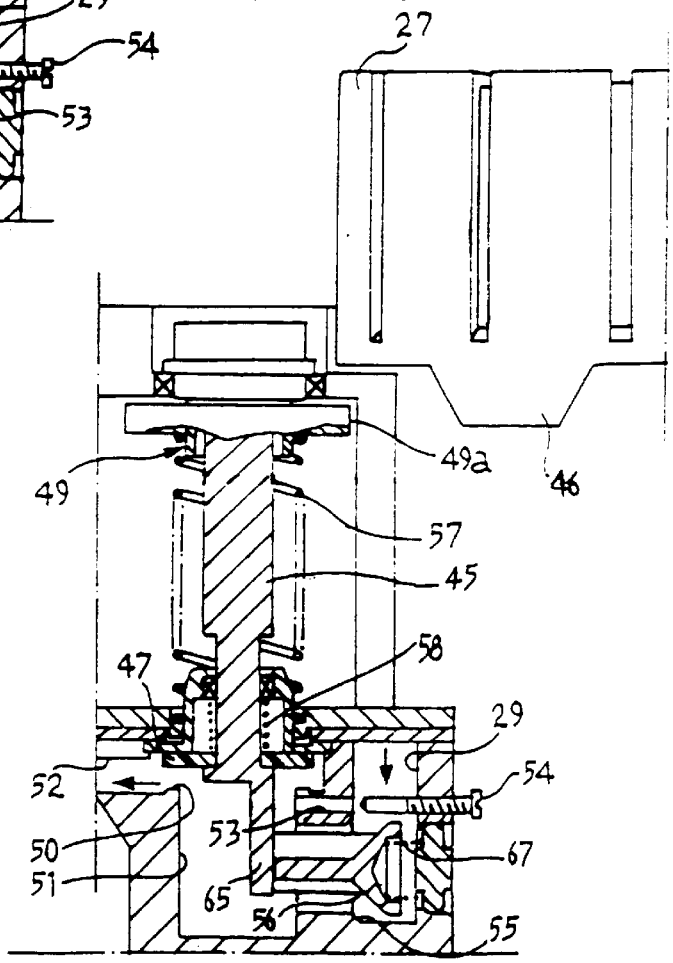
Figure 6:
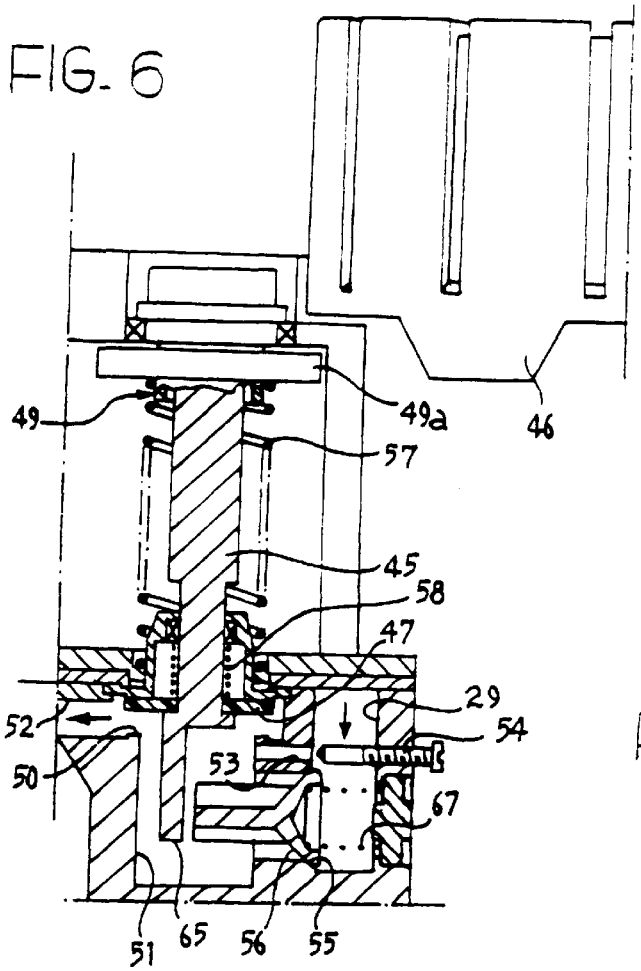

The rod 45 is kept in the rest position shown in FIGS. 5 and 6 by the action of a flange 49*a* of the operating element 49 which is acted on by the resilient load of a spring 57. The cam 46 interferes with the flange 49*a* in order to move the flange axially in opposition to the spring 57 so as to cancel out the resilient load of the spring exerted on the rod 45 (FIG. 4).

A further spring 58 disposed between a shoulder of the valve body and the first closure plate 47 acts on the closure plate with a predetermined resilient preloading exerted in opposition to the spring 57. The resilient characteristic selected for the spring 58 is such that, when the rod 45 is in the rest position (FIGS. 5 and 6), the resilient load exerted by the spring 57 is greater than the resilient preloading of the spring 58 so that the closure plate 47 is kept removed from the corresponding seat 50, allowing the gas to flow from the secondary duct 29 to the outlet opening 16.

On the other hand, when the resilient load of the spring 57 is cancelled out by the action of the flange 49*a*, the resilient preloading of the spring 58 is such as to move the annular closure plate 47 into abutment with the annular projection of the seat 50, thus closing the passageway for the gas between the secondary duct 29 and the outlet opening 16.

As well as rotating about its own axis, the knob 27 can be moved longitudinally towards the valve body 41 against the force of spring means not visible in the drawings. When the knob 27 is in a predetermined angular position, this movement causes it to interfere with the manual operating member 23 of the safety valve 20. It can be seen that, in this angular position, the cam 46 interferes with the flange 49*a* (FIG. 4) so that gas is prevented from flowing to the opening 16 by the closure of the plate 47. The knob 27 thus forms a mechanical coupling between the operating members of the on/off valve 30 and of the safety valve 20 so that the former is closed when the latter is opened in order to light the pilot light, as explained with reference to FIG. 1. It can also be seen that the shape and arrangement of the cam 46 on the knob 27 is such that, when the knob is rotated to the position in which the regulation valve 25 is closed in order to close the passageway for the gas to the main burner 13, the cam 46 interferes with the flange 49*a* so as to close the closure plate 47 and also to prevent the gas from flowing to the secondary burner 17. In the embodiment illustrated, the flow-adjustment valve 31 is in practice integrated with the on/off valve 30. The operating slide 44 is connected by means of a flexible tongue 63 to an arm 64 of an annular element 64*a* fixed for rotation with the head of the rod 45 so that the rod is rotated about its own axis by a linear movement of the slide. The axially opposite end of the rod 45 to its head has an appendage 65 arranged eccentrically relative to the axis of the rod and acting on the second closure element 56 in order to move the latter relative to its seat 55 in opposition to a spring 67 and thus to modulate the gas-flow in dependence on the angular position of the rod 45. In FIGS. 5 and 6, the second closure element 56 is shown in the positions in which it is fully open and in which it closes the seat 55, respectively.

Figure 7:
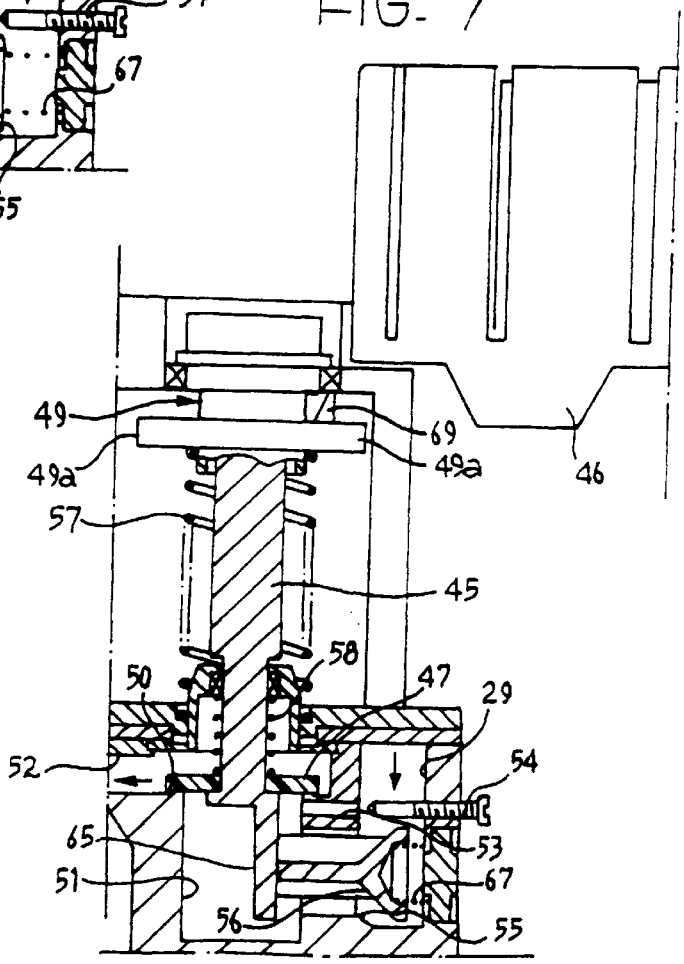
Figure 8:
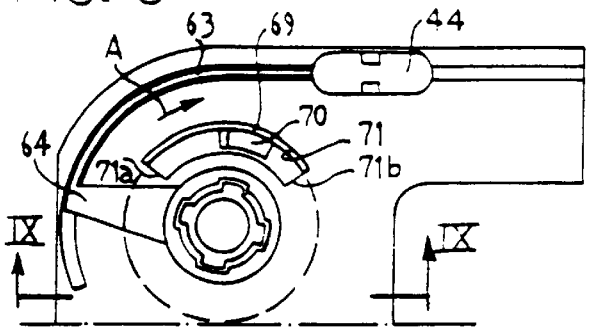
FIG. 8 is a partial plan view of a detail of the device of the previous drawings.
Figure 9:
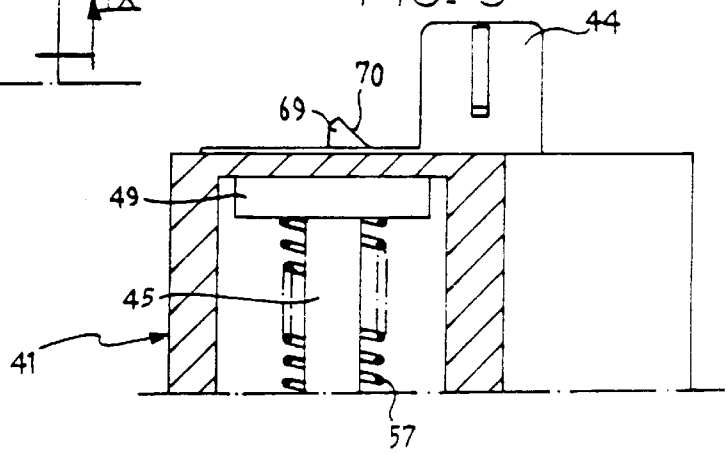
FIG. 9 is a section taken on the line IX—IX of FIG. 8.
Figure 10:
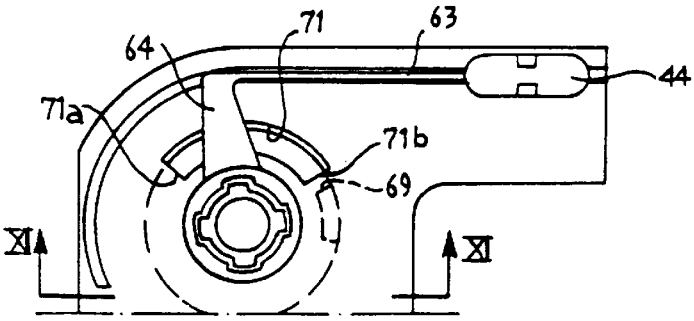
FIG. 10 is a view corresponding to that of FIG. 8 with the device of the invention in a different operating condition.
Figure 11:
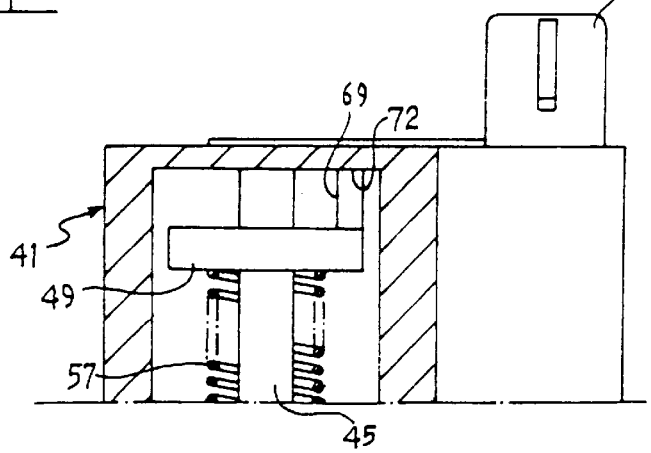
FIG. 11 is a section taken on the line XI—XI of FIG. 10.

With reference to FIGS. 7 to 11, the flange of the operating element 49 has a cam 69 defining a ramp 70. The cam 69 is housed in a slot 71 formed along an arc of a circle in the valve body. As a result of the rotation of the rod 45 about its own axis between the positions in which the seat 55 is closed (FIG. 6) and fully open (FIG. 5), the cam 69 is moved between respective opposite ends 71*a*, 71*b* of the slot 71. Starting from the position in which the cam 69 is in abutment with the end 71*b* of the slot, a further rotation of the rod 45 in the direction of the arrow A of FIG. 8 causes the ramp 70 to be brought into engagement with a surface 72 of the valve body 41 so as to bring about an axial movement of the flange 49 along the rod 45 away from the head thereof, in opposition to the spring 57 (FIGS. 7 and 11). This movement cancels out the resilient load of the spring 57 on the rod 45 in a manner similar to the effect achieved by means of the cam 46 of the knob 27, bringing about closure of the first closure plate 47 onto the corresponding seat 50 by the effect of the resilient preloading of the spring 58 alone.

In this position, the flow-adjustment valve 31 is closed, preventing gas from flowing to the secondary burner, regardless of the operative position of the knob 27. The invention thus solves the problem set, achieving many advantages in comparison with known solutions.

A first advantage lies in the fact that, by virtue of the mechanical coupling between the manual arming member 23 and the on/off valve 30 by means of the knob 27, during the lighting stage, that is, when the safety valve 20 is opened manually in order to supply the pilot burner 15, gas is in any case prevented from flowing towards the secondary burner 17, regardless whether the flow-adjustment valve 31 is in the open or closed position, and can be allowed to flow only by a deliberate operation by the user, by rotation of the knob 27.

Another advantage is that the gas-supply to the secondary burner 17 is shut off by the closure of the regulation valve 25 both during the lighting of the main burner 13 and during the extinguishing thereof.

Another advantage is that, once the gas has been allowed to flow towards the secondary burner 17, the flow of gas is modulated between a minimum and a maximum and is shut off by means of the adjustment-valve 31, independently of the regulation valve 25 of the main burner.

A further advantage lies in the fact that the provision of the slide 44 enables the gas-flow to the secondary burner to be modulated and the passageway for the gas to this burner to be closed by an exclusively linear movement.

What is claimed is:

1. A device for controlling the supply of gas to gas burners, comprising:

a main supply duct for supplying gas, a safety valve disposed in said main supply duct and having an actuator with a manual arming member for manual arming of the actuator, a regulation valve disposed in said main supply duct downstream of the safety valve for supplying gas to a main burner, a tapping duct connected to said main supply duct between the safety valve and the regulation valve for supplying gas to a pilot burner, a flame detector associated with the pilot burner and connected to the actuator of the safety valve for supplying the actuator of the safety valve with sufficient energy to hold the safety valve open after the manual arming by said manual arming member, when a flame is present in the pilot burner, a branch duct connected to said main supply duct between the safety valve and the tapping duct for supplying gas to a secondary burner, and an on/off valve disposed in the branch duct and having operating means for controlling the supply of gas to the secondary burner, mechanical means for coupling the operating means to the manual arming member of the actuator of the safety valve for maintaning closing of the on/off valve during manual arming to prevent the supply of gas to the secondary burner, until the main burner is lit.

2. A device according to claim 1, comprising a control unit including the control knob, and a body which contains the safety valve, the manual arming member, the regulation valve, the on/off valve and the operating means therefor, in which the control unit acts on the manual arming member and on the operating means of the on/off valve when the control knob is in a predetermined angular position and is pushed against the body.

3. A device according to claim 2, in which the operating means of the on/off valve comprise a closure element with an operating element projecting from the body, and the control knob has a cam which interferes with the operating element when the control knob is in the predetermined angular position.

4. A device according claim 1, further comprising manual adjustment means for adjusting the gas-flow in the branch duct.

5. A device according to claim 4, in which the manual adjustment means are integrated with the on/off valve.

6. A device according to claim 1, in which the regulation valve is a thermostatic valve.

7. A device according to claim 1, in which the actuator of the safety valve is an electromagnet and the flame detector comprises at least one thermocouple.

8. A device according to claim 1, in which the on/off valve comprises a closure element acted on by first resilient means with predetermined resilient preloading in order to close a valve seat, second resilient means acting on the closure element in opposition to the first resilient means in order to exert a resilient load greater than the preloading, the control element acting on the second resilient means in order to cancel out the action of the resilient load on the closure element so that it is subjected solely to the resilient preloading.

9. A device according to claim 8, in which the operating element comprises a flange, the flange being fixed for rotation with an operating rod of the manual adjustment means and being interposed between the second resilient means and an axial abutment on the rod, as well as being slidable on the rod from a position in abutment with the axial abutment in order to cancel out the resilient load of the second resilient means.

10. A device according to claim 9, in which cam means are provided between the flange and a stationary portion of the valve body in order to move the flange from the position in abutment with the axial abutment so as to cancel out the resilient load of the second resilient means when the flange is rotated to a predetermined angular position.

11. A device according to claim 10, in which the flange is positioned on the valve body so as to be moved along the rod away from the axial abutment in order to cancel out the resilient load of the second resilient means when the knob is pushed towards the valve body in the arming position.

12. A device according to claim 4, in which the manual adjustment means comprise a flow-adjustment valve with a linear slide control.

13. A device according to claim 12, in which the flow-adjustment valve comprises a slide connected, by means of a flexible tongue and an arm, to an operating rod of a second closure element of the valve.

14. A device according to claim 13, in which the rod acts on the closure element of the on/off valve in order to operate it by means of the second resilient means.

* * * * *